US007198389B1

(12) United States Patent
Kwong et al.

(10) Patent No.: US 7,198,389 B1
(45) Date of Patent: Apr. 3, 2007

(54) LAMP WITH SPOT LIGHT AND FLOOD LIGHT FEATURES

(75) Inventors: Allan Hing Chuen Kwong, Shatin (HK); Richard Takata, Newport Beach, CA (US)

(73) Assignee: Regal King Comercial Offshore De Macau Limitada, SAR, PRC, Macao (CN)

( * ) Notice: Subject to any disclaimer, the term of this patent is extended or adjusted under 35 U.S.C. 154(b) by 175 days.

(21) Appl. No.: 10/951,195

(22) Filed: Sep. 27, 2004

(51) Int. Cl.
*F21V 5/00* (2006.01)

(52) U.S. Cl. ..... 362/329; 362/310; 313/113; 313/318.11; 313/318.12

(58) Field of Classification Search ..... 362/260–263, 362/296, 298–300, 307–308, 310, 326–327, 362/329, 341, 351, 353, 355; 313/113–115, 313/317, 318.11, 318.12
See application file for complete search history.

(56) References Cited

U.S. PATENT DOCUMENTS

| | | | | |
|---|---|---|---|---|
| 3,330,951 | A | 7/1967 | Neal | |
| 3,401,258 | A * | 9/1968 | Guth | 362/349 |
| 4,506,316 | A | 3/1985 | Thiry et al. | |
| 4,755,916 | A * | 7/1988 | Collins | 362/236 |
| 4,761,721 | A | 8/1988 | Willing | |
| D302,863 | S | 8/1989 | Krol | D26/26 |
| 4,870,551 | A * | 9/1989 | Nagel | 362/263 |
| D325,994 | S | 5/1992 | Hume et al. | D26/2 |
| D379,537 | S | 5/1997 | Gallant et al. | D26/2 |
| 5,703,428 | A * | 12/1997 | Borgis | 313/318.1 |
| D398,407 | S | 9/1998 | O'Connell | D26/2 |
| 6,004,003 | A | 12/1999 | Dalton et al. | |
| 6,053,623 | A | 4/2000 | Jones et al. | |
| 6,218,785 | B1 * | 4/2001 | Incerti | 315/185 S |
| D467,358 | S | 12/2002 | Morris | D26/2 |
| 6,502,953 | B2 | 1/2003 | Hajianpour | |
| D470,607 | S | 2/2003 | Bobel | D26/2 |
| 6,739,737 | B2 | 5/2004 | Yu | |
| D498,310 | S | 11/2004 | Gagnon et al. | D26/2 |
| D516,229 | S | 2/2006 | Tang | D26/2 |
| 2004/0145293 | A1 | 7/2004 | Zhao | |
| 2005/0018432 | A1 | 1/2005 | Buschmann et al. | |

OTHER PUBLICATIONS

PEC LAMP Online Store, 50W MR16 Wide Open 120V GU10, webpage image from http://store.peclamp.com/331033.html.

(Continued)

*Primary Examiner*—Sandra O'Shea
*Assistant Examiner*—Jason Moon Han
(74) *Attorney, Agent, or Firm*—Baker, Donelson, Bearman, Caldwell & Berkowitz

(57) ABSTRACT

A lamp with combined spot and flood light distribution properties in which an elongate translucent shell defines an interior cavity with a reflector portion and a neck portion. A socket-engaging base includes a pair of electrical contact members for communicating with respective electrical contacts of a socket of a light fixture. A lamp capsule, disposed in the interior cavity, includes a light source that connects to a pair of electrical leads for connecting to electrical contact members of the socket. The light emitted from the light source communicates diffusingly radially omni-directionally through the neck portion and directedly substantially longitudinally from the reflector portion.

23 Claims, 2 Drawing Sheets

OTHER PUBLICATIONS

The Home Depot, Philips 120 Volt 75 Watt ER-30 Glass Incandescent Bulb, webpage image from www.hopedepot.com/pre180/HDUS/EN_US/shop_cart/pg_print_product.jsp?CNTTY... .

The Home Depot, Philips 45 Watt Floodlight PAR16 Halogen Bulb, webpage image from www.hopedepot.com/pre180/HDUS/EN_US/shop_cart/pg_print_product.jsp?CNTTY... .

The Home Depot, Philips 60 Watt Halogen PAR 16 Flood Bulb, webpage image from www.hopedepot.com/pre180/HDUS/EN_US/shop_cart/pg_print_product.jsp?CNTTY... .

The Home Depot, Philips 120 Volt 75 Watt BR-30 Glass Incandescent Bulb, webpage image from www.hopedepot.com/pre180/HDUS/EN_US/shop_cart/pg_print_product.jsp?CNTTY... .

The Home Depot, Philips 50 Watt Halogen PAR 20 Spot Bulb, webpage image from www.hopedepot.com/pre180/HDUS/EN_US/shop_cart/pg_print_product.jsp?CNTTY... .

The Home Depot, Philips 20 Watt 12 Volt MR-16 Tungsten Halogen Bulb, webpage image from www.hopedepot.com/pre180/HDUS/EN_US/shop_cart/pg_print_product.jsp?CNTTY... .

Lamp Specification & Application Guide 2004, Philips Lighting Company, 200 Franklin Square Drive, Somerset, NJ 08875-6800, pp. 5, 8, 10, 11, 39, 49, 50, 96, with cover page, "How To Use" page, and Table of Contents.

Philips Flood/Spot Mini-Reflector Bulb, webpage www.nam.lighting.philips.com/US/Consumer/products_duramax_IFSR.php (access thru "Find the bulb you need" by shape).

Philips DuraMax Long Life Reflectors, Philips Lighting, Markham, Ontario, Canada, brochure.

U.S. Appl. No. 29/219,042 filed Dec. 10, 2004, Kwong et al.

2-pin / 2-lug type bulb bases, 5 pages, Don's Bulbs, www.donsbulbs.com, (prior to Dec. 10, 2004).

GU1O base, Don's Bulbs, www.donsbulbs.com/bulbs/g/b/gu10.gif, prior to Dec. 10, 2004).

MR16 bulb, Don's Bulbs, www.donsbulbs.com/bulbs/g/g/mr-16.gif, prior to Dec. 10, 2004).

* cited by examiner

LAMP WITH SPOT LIGHT AND FLOOD LIGHT FEATURES

TECHNICAL FIELD

The present invention relates to lamps. More particularly the present invention relates to reflector lamps providing spotlight features in combination with diffused flood light characteristics.

BACKGROUND OF THE INVENTION

In recent years, track lighting fixtures have become increasingly popular for both ornamental affect in interior design for lighting room interiors as well as featured lighting for illuminating specific portions of cabinets, artwork, and the like. Track lighting fixtures include an adapter that detachably engages the fixture to the track having electrical conductors for communicating electrical current to the lamp held within the fixture. The fixtures include an ornamental housing that encloses the lamp seated in a socket of the fixture. Light emits through an open end of the housing opposing the closed end having the socket for the lamp. The track lighting fixtures typically are metallic or opaque to light transmission except from the open end. Often the fixtures include pivoting and/or rotational connections whereby the housing can be selectively oriented relative to the track for directing the light in a particular direction.

The lamps used in such fixtures are often of a spot-light type lamp. The lamp includes a reflector portion and a neck portion. The light is generally emitted in a concentrated manner from the lamp. These lamps include a reflective surface on the interior of the lamp housing. The reflective surface directs the light emitted by the bulb within the lamp forwardly in the concentrated light pattern. The reflector portion can be parabolic, spherical, elliptical, or other surface providing optically reflective characteristics.

In contrast, a broader, general area illumination is provided by flood-type lamps or conventional lamps having omni-directional light dispersion characteristics. These lamps lack an interior reflective surface. These lamps disperse light generally about the lamp for area illumination.

Recently, track lighting fixtures have been available with translucent glass or ceramic shades. The illuminative effect from these translucent shades has been found unsatisfactory when used with spot-light type lamps. A forward portion of the shade is partially illuminated with light from conventional spot lamps while a base portion of the shade has a darker appearance. While a conventional bulb could be used providing illuminative effect over a greater portion of the shade, the fixture no longer would be as satisfactory when functioning for spot light applications.

Accordingly, there is a need in the art for an improved lamp directed to providing spot light features together with flood light characteristics. It is to such that the present invention is directed.

SUMMARY OF THE INVENTION

The present invention meets the need in the art by providing a lamp having combined spot light and flood light distribution properties in which an elongate translucent shell defines an interior cavity and has a reflector portion and a neck portion. A socket-engaging base attaches to the neck portion and includes a pair of electrical contact members for communicating with respective electrical contacts of a socket of a light fixture. A lamp capsule, disposed in the interior cavity, includes a light source that connects to a pair of electrical leads that extend from the capsule and connect to the pair of electrical contact members. The light emitted from the light source communicates both diffusingly radially through the neck portion and directedly substantially longitudinally from the reflector portion.

Objects, advantages, and features of the present invention will become apparent upon reading the following detailed description in conjunction with the drawings and the appended claims.

DETAILED DESCRIPTION

Figure 1:
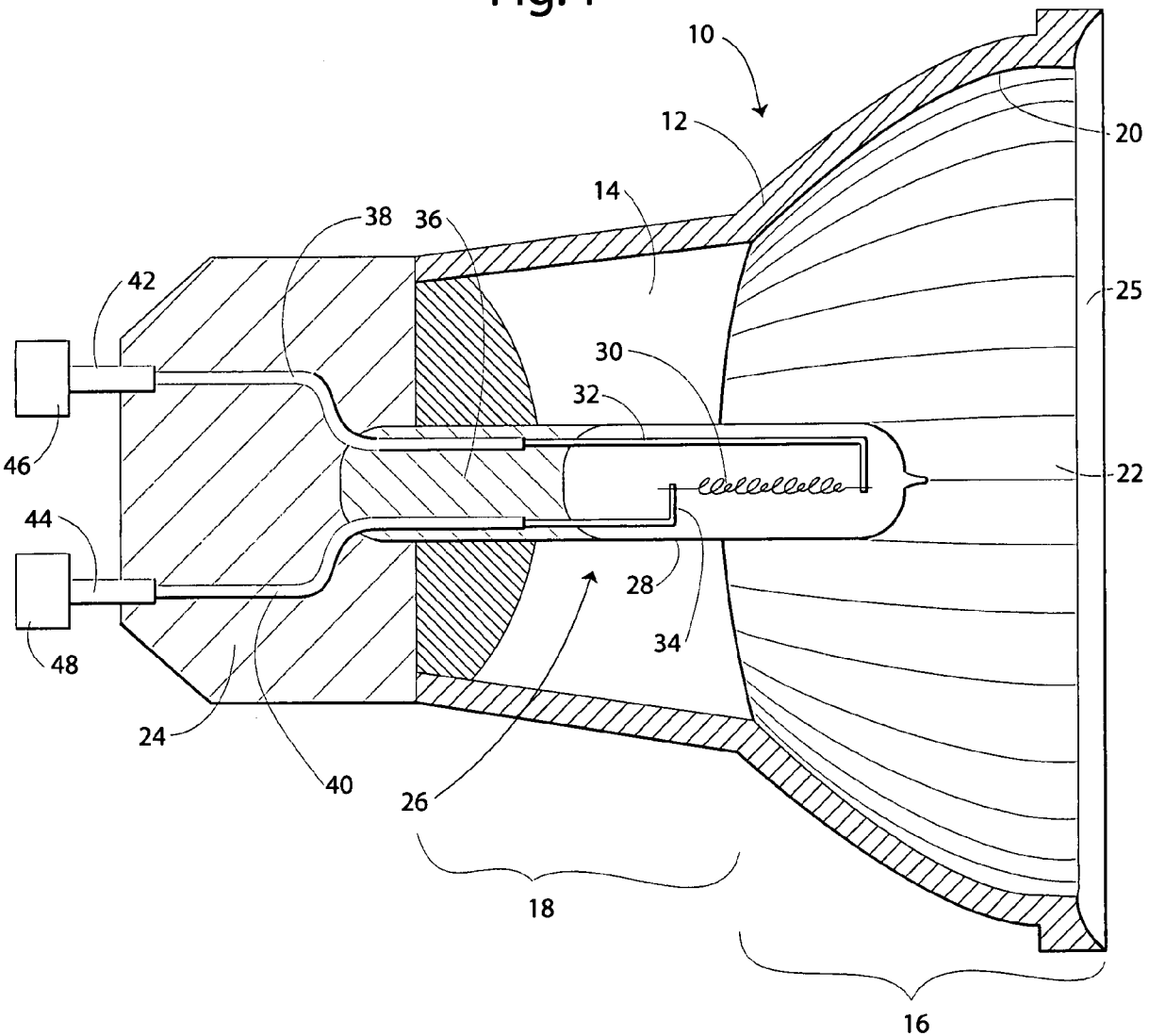
FIG. 1 is a side cross-sectional view of a lamp according to the present invention.

Referring now in more detail to the drawings, in which like parts have like identifiers, FIG. 1 illustrates a side cross-sectional view of a lamp 10 that upon illumination by electrical current, emits light having combined spot and flood light distribution properties. The lamp 10 comprises an elongate translucent shell 12 that defines an interior cavity 14. The shell 12 defines a reflector portion 16 and a flood portion 18. The reflector portion 16 includes a light reflecting surface 20 that extends from a light emitting end 22 to the flood portion 18 generally intermediate the end 22 and a base 24. The light emitting end 22 can be open. The illustrated embodiment provides a tungsten-halogen light source, so the end 22 is closed by a halogen appropriate glass lens 25. In the illustrated embodiment, the reflector portion 18 is frustroconical in cross-sectional view having a major diameter at the end 22 and a minor diameter at the transition to the flood portion 18. The interior surface of the shell 12 in the reflector portion 16 includes grooves and ridges to provide additional facets or reflective surfaces for communication of light from the end 22.

The flood portion 18 in the illustrated embodiment defines a second frustroconical shape in cross-sectional view with a major diameter at the transition with the reflector portion 16 and a minor diameter at the connection of the flood portion 18 with the base 24. The inner surface of the shell lacks a reflective or opaque surface, allowing light to communicate through the shell 12.

A light source generally 26 mounts in the interior cavity 14. The light source comprises a light capsule 28 or glass envelope that houses a light emitter or filament 30 connected to wire supports 32, 34 held in a potting material 36. The light capsule 28 is disposed so that a respective portion aligns with the reflector portion 16 and with the flood portion 18. The wire supports 32, 34 connect to electrical leads 38, 40 that extend outwardly of the light capsule 28. The leads 38, 40 connect to electrical contacts 42, 44 in the base 24. In the illustrated embodiment, the electrical contacts 42, 44 are metal pins disposed in passageways in the base 24 and extend longitudinally from the base 24. The electrical contacts 42, 44 terminate in feet 44, 46. The feet 46, 48 have diameters greater than the diameters of the pins 42, 44. Other electrical contacts could be used, such as bayonet, screw, or other type.

Figure 2:
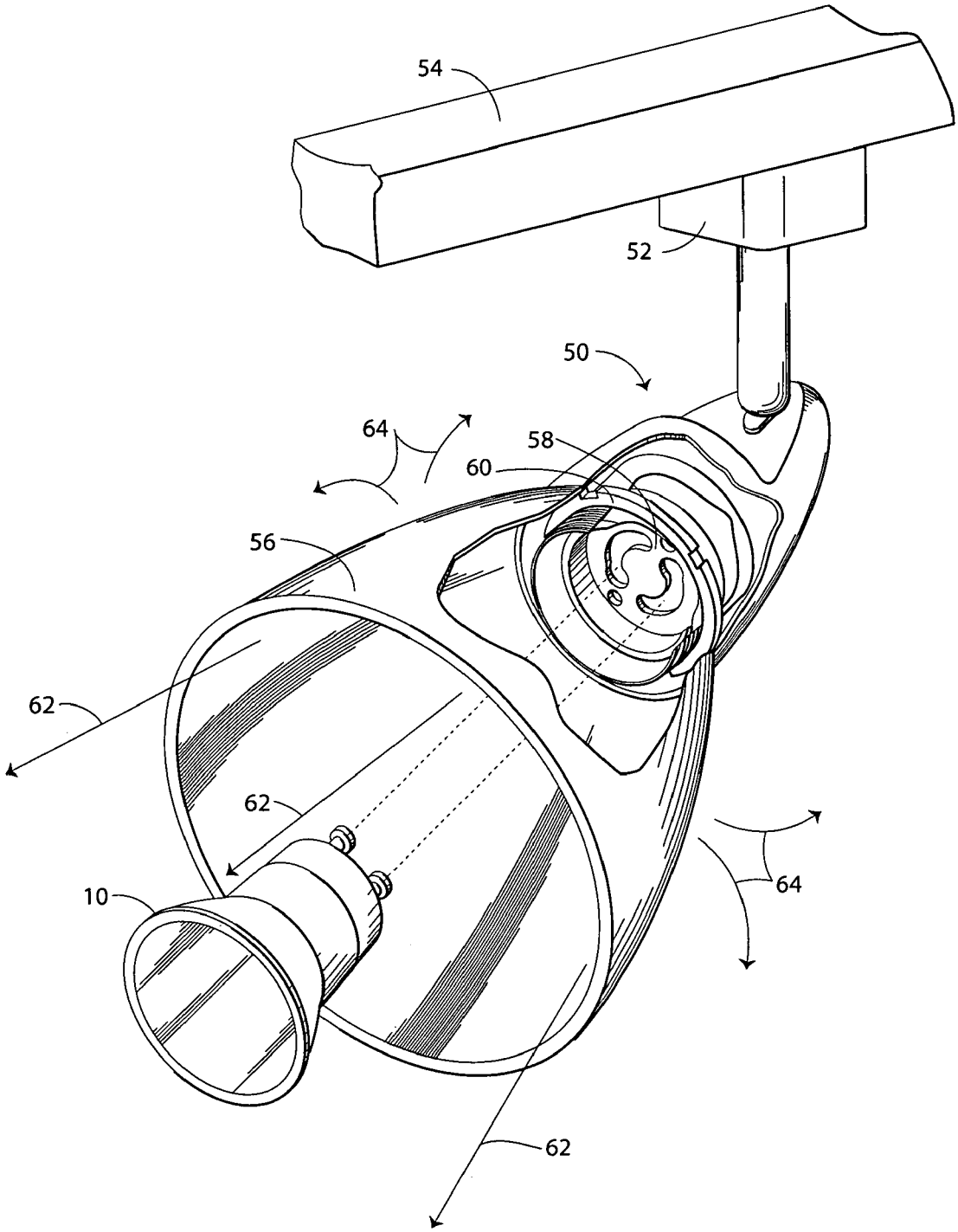
FIG. 2 is a perspective view of a track lighting fixture that uses the lamp illustrated in FIG. 1.

FIG. 2 is a perspective view illustrating a light fixture 50 selectively connected by a mounting bracket 52 to a track 54 for a track lighting fixture. The tracks and mounting brackets for track lighting fixtures are conventional and well known in the art, and no further detail is provided, except to note that the track and adapter provide for communication of electrical current from a supply of electricity to the lamp held in the lighting fixture. The illustrated lighting fixture 50 includes a shade 56 that mounts to a threaded socket 58 using a fastener 60. The shade 56 is a light translucent ceramic or glass shade. The socket 58 is configured for mating reception of the extending pins 42, 44 and feet 46, 48 for communication of electricity from the supply to the light capsule 28. The lamp 10 seats in the socket 58 in a conventional manner by inserting the feet 46 in slotted openings in the socket 58 and rotating the lamp 10 to seat the feet 46, 48 in narrowed flanged slots.

In operation, the lamp 10 emits focused light communicated from the reflector portion 16 substantially longitudinally as indicated by the arrows 62 through the open end of the shade 56. The lamp 10 further provides a generally omni-directional emission of light from the flood portion 18 through the shade 56 as indicated by the arrows 64.

The illustrated lamp 10 is exemplary and without limitation of lamps according to the present invention that exhibit both spot light and flood light characteristics. The reflector portion 16 complies with MR11 standards for a reflector lamp while in the base 24 and electrical contacts 42, 44 with the feet 44, 46 complies with GU10 standards. The contacts 42, 44 are disposed 10 mm (center-to-center) apart (70) extending 6 mm from the base (72). The shell has an outside diameter of 35 mm at the end 22 (74) and tapers to the diameter of 24 mm at the transition between the reflector portion 16 and the neck portion 18. The neck portion has a shallower taper to the diameter of 22 mm at the base 24. A distal end of the base 24 has a bevel edge 76 tapering to 15 mm. The reflector portion 16 and the neck portion are a combined length (78) of 27.5 mm, while the lamp has an overall length of 47.5 mm (80) from the end 22 to the extent of the feet 46, 48. The light source is tungsten-halogen operating at 120 volts AC and 20 watts with a color temperature of 2700° K.

The specification as described above the present invention that provides a lamp with combined spot light and flood light distribution properties useful with lighting fixtures, including the steps necessary for making and using various embodiments thereof. It is to be understood, however, that numerous changes and variations may be made in the construction of the lamp within the spirit and scope of the present invention and that modifications and changes may be made therein without departing from the scope thereof as set for the in the appended claims.

What is claimed is:

1. A lamp providing combined spot and flood light distribution properties, comprising:

an elongate translucent shell defining an interior cavity and having a reflector portion with a reflective surface thereon so that light is directed substantially longitudinally from an end of the shell and a neck portion lacking a reflective surface so that light emits through the shell substantially radially omni-directionally therethrough;

a socket-engaging base attached to the neck portion and including a pair of electrical contact members for communicating with respective electrical contacts of a socket of a light fixture for communicating with a supply of electricity; and a lamp capsule disposed within the interior cavity and having a light source therein connected to a pair of electrical leads that extend therefrom for communicating with the electrical contact members, whereby light emitted from the light source communicates diffusingly radially omni-directionally through the neck portion and directedly substantially longitudinally from the reflector portion.

2. The lamp as recited in claim 1, wherein the reflector portion is frustroconical.

3. The lamp as recited in claim 2, wherein the neck portion is frustroconical.

4. The lamp as recited in claim 2, further comprising a lens covering a major end of the major frustroconical reflector portion.

5. The lamp as recited in claim 4, wherein the electrical contact members each comprise a longitudinally extending member of a first diameter and terminated in a foot having a second diameter.

6. The lamp as recited in claim 5, wherein the light source comprises a halogen light source.

7. The lamp as recited in claim 2, wherein the shell of the lamp is made from a frosted glass.

8. The lamp as recited in claim 2, wherein an interior surface of the shell in the reflector portion is coated to reflect light.

9. The lamp as recited in claim 1, further comprising a lens covering a major end of the major frustroconical reflector portion.

10. The lamp as recited in claim 1, wherein the electrical contact members each comprise a longitudinally extending member of a first diameter and terminated in a foot having a second diameter.

11. The lamp as recited in claim 1, wherein the light source comprises a tungsten-halogen light source and further comprising a glass lens at a light emitting end.

12. The lamp as recited in claim 11, wherein a distal end of the reflector portion has a 35 mm diameter.

13. The lamp as recited in claim 12, wherein the electrical contact members are spaced apart on a 10 mm center.

14. The lamp as recited in claim 1, wherein the shell of the lamp is made from a frosted glass material.

15. The lamp as recited in claim 1, wherein an interior surface of the shell in the reflector portion is coated to reflect light.

16. A lamp providing combined spot and flood light distribution properties, comprising:

an elongate translucent shell defining an interior cavity and having a major frustroconical reflector portion with a reflective surface thereon so that light is directed substantially longitudinally and a minor frustroconical light transmissive portion lacking a reflective surface so that light emits through the shell substantially omni-directionally therethrough;

a socket-engaging base attached to a minor diameter of the light transmissive portion and including a pair of electrical contact members for communicating with respective electrical contacts of a socket of a light fixture for communicating with a supply of electricity; and a lamp capsule having a light source therein connected to a pair of electrical leads that extend therefrom and electrically communicate with the electrical contacts for communicating with the supply of electricity, said lamp capsule disposed within the interior cavity with a portion within the light transmissive portion and a portion within the reflector portion, whereby light emitted from the light source communicates diffusingly radially omni-directionally through the shell defining the minor frustroconical light transmissive portion and directedly substantially longitudinally from the major frustroconical reflector portion.

17. The lamp as recited in claim 16, further comprising a lens covering a major end of the major frustroconical reflector portion.

18. The lamp as recited in claim 16, wherein the electrical contact members each comprise a longitudinally extending member of a first diameter and terminated in a foot having a second diameter.

19. The lamp as recited in claim 16, wherein the light source comprises a tungsten-halogen light source and further comprising a glass lens covering a light emitting end of the shell.

20. The lamp as recited in claim 19, wherein a distal end of the reflector portion has a 35 mm diameter.

21. The lamp as recited in claim 20, wherein the electrical contact members are spaced apart on a 10 mm center.

22. The lamp as recited in claim 16, wherein the shell of the lamp is made from a frosted glass material.

23. The lamp as recited in claim 16, wherein an interior surface of the shell in the reflector portion is coated to reflect light.

* * * * *